US010858913B2

(12) United States Patent
Lin et al.

(10) Patent No.: US 10,858,913 B2
(45) **Date of Patent: *Dec. 8, 2020**

(54) PERMEABILITY ENHANCEMENT METHOD FOR COALBED METHANE WELLS BY USING ELECTRIC PULSE DETONATION FRACTURING TECHNOLOGY

(71) Applicant: CHINA UNIVERSITY OF MINING AND TECHNOLOGY, Jiangsu (CN)

(72) Inventors: Bai quan Lin, Jiangsu (CN); Fazhi Yan, Jiangsu (CN); Xiangliang Zhang, Jiangsu (CN); Jia Kong, Jiangsu (CN); Ting Liu, Jiangsu (CN); Chuanjie Zhu, Jiangsu (CN)

(73) Assignee: CHINA UNIVERSITY OF MINING AND TECHNOLOGY, Xuzhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/767,880

(22) PCT Filed: Dec. 15, 2016

(86) PCT No.: PCT/CN2016/110047
§ 371 (c)(1),
(2) Date: Apr. 12, 2018

(87) PCT Pub. No.: WO2018/076492
PCT Pub. Date: May 3, 2018

(65) Prior Publication Data

US 2020/0240246 A1 Jul. 30, 2020

(30) Foreign Application Priority Data

Oct. 28, 2016 (CN) ..... 2016 1 0970304

(51) Int. Cl.
*E21B 43/00* (2006.01)
*E21B 43/26* (2006.01)
(Continued)

(52) U.S. Cl.
CPC ..... *E21B 43/006* (2013.01); *E21B 43/26* (2013.01); *E21B 43/17* (2013.01); *E21B 43/2401* (2013.01); *E21B 43/30* (2013.01); *E21F 7/00* (2013.01)

(58) Field of Classification Search
None
See application file for complete search history.

(56) References Cited

U.S. PATENT DOCUMENTS 4,084,638 A 4/1978 Whiting
4,997,044 A * 3/1991 Stack ..... E21B 17/003 166/177.2
(Continued)

FOREIGN PATENT DOCUMENTS

CN 104453827 A 3/2015
CN 104832149 A 8/2015
(Continued)

OTHER PUBLICATIONS

International Search Report and Written Opinion issued in corresponding application No. PCT/CN2016/110047 dated Jul. 24, 2017.

*Primary Examiner* — Andrew Sue-Ako
(74) *Attorney, Agent, or Firm* — Foley & Lardner LLP

(57) ABSTRACT

A permeability enhancement method for coalbed methane wells by using electric pulse detonation fracturing technology is applicable to exploitation of coalbed methane wells in coal beds with low permeability. Firstly, a positive electrode
(Continued)

coalbed methane wellbore and a negative electrode coalbed methane wellbore are constructed from the ground surface to a coal bed. A fixed platform installed with a positive electrode and a high-voltage pulse device are placed, by using a derrick, downwards to a predetermined permeability enhancement portion of the coal bed in the positive electrode coalbed methane wellbore, and another fixed platform installed with a negative electrode is placed, by using a derrick, downwards to a predetermined permeability enhancement portion of the coal bed in the negative electrode coalbed methane wellbore. The coal bed between the positive electrode and the negative electrode is broken down by using a high voltage, and coalbed methane extraction is carried out in the positive electrode coalbed methane wellbore and the negative electrode coalbed methane wellbore. A large amount of energy produced by high-voltage electric pulse directly acts on the coal reservoir to form a plasma channel in the coal bed between the positive electrode and the negative electrode. The large amount of energy instantly passes through the plasma channel, and the produced high-temperature thermal expansion force and shock waves act on the coal bed, such that the number of cracks in the coal bed is effectively increased and a favorable condition is created for flowing of coalbed methane.

3 Claims, 1 Drawing Sheet

(51) Int. Cl.

| | |
|---|---|
| *E21B 43/17* | (2006.01) |
| *E21B 43/24* | (2006.01) |
| *E21B 43/30* | (2006.01) |
| *E21F 7/00* | (2006.01) |

(56) References Cited

U.S. PATENT DOCUMENTS

| | | | | |
|---|---|---|---|---|
| 9,951,597 | B1 * | 4/2018 | Lin | E21F 7/00 |
| 2015/0167439 | A1 * | 6/2015 | Kasevich | E21B 43/168 166/248 |

FOREIGN PATENT DOCUMENTS

| | | | |
|---|---|---|---|
| CN | 104863561 | A | 8/2015 |
| CN | 104863628 | A | 8/2015 |
| CN | 105370257 | A | 3/2016 |

* cited by examiner

PERMEABILITY ENHANCEMENT METHOD FOR COALBED METHANE WELLS BY USING ELECTRIC PULSE DETONATION FRACTURING TECHNOLOGY

CROSS REFERENCE TO RELATED APPLICATIONS

The present application is a national stage entry of International Patent Application No. PCT/CN2016/110047, filed Dec. 15, 2016, which claims priority to Chinese Patent Application No. 201610970304.X, filed Oct. 28, 2016, each of which is incorporated herein by reference in its entirety.

BACKGROUND OF THE INVENTION

Field of the Invention

The present invention relates to a permeability enhancement method by using electric pulse detonation fracturing technology, and in particular to, a permeability enhancement method for coalbed methane wells by using electric pulse detonation fracturing technology which is applicable to high-efficiency exploitation of coalbed methane.

Description of Related Art

Coalbed methane is a kind of clean energy. The geological resource reserves of coalbed methane buried less than 2000 m deep underground in China rank the third in the world, and have great potential for exploitation. However, the geological conditions for occurrence of coalbed methane are complicated in China, and coalbed methane exploitation generally faces problems of high cost and low efficiency. To increase the yield of coalbed methane, measures such as displacement by gas injection, hydrofracturing and multi-branch horizontal well are applied in reconstruction of coalbed methane wells to increase the yield, in which hydrofracturing is the most commonly used technical means in current coalbed methane exploitation. However, the conventional hydrofracturing technique produces a small number of cracks in a coal bed, and the cracks extend in a small range. Therefore, the overall fracturing effect is undesirable, which finally results in low yield of coalbed methane per well.

In recent decades, high-power electric pulse techniques have been developed rapidly, and in China, some researches are made on methods for increasing permeability of reservoirs by using high-power electric pulse techniques. For example, in Patent Publication No. CN 104832149A entitled "Unconventional Permeability Enhancement Method for Natural Gas Reservoirs by Using Electric Pulse Assisted Hydrofracturing", water with certain pressure is injected into a drilled hole, and the permeability of a reservoir is increased by using the cavitation effect and water shock waves produced by discharge of a discharge device in water. However, traveling in the form of spherical waves, the shock waves produced by discharge in water attenuate fast when traveling around. Therefore, the method has a limited effective impact range and low efficiency. In Patent Publication No. CN105370257A entitled "Method for Increasing Yield of Coalbed Methane Wells by Using High-Power Electric Detonation Assisted Hydrofracturing", hydrofracturing and high-voltage electric pulse are organically combined, and shock waves formed by discharge of a high-voltage electric pulse device in fracturing fluid are used to effectively increase the number of cracks in a coal bed. However, the method has a problem that the effective impact range is relatively small as the shock waves formed by discharge in water travel in the form of spherical waves.

SUMMARY OF THE INVENTION

Technical problem: an objective of the present invention is to solve the problems in the prior art and provide a permeability enhancement method for coalbed methane wells by using electric pulse detonation fracturing technology, in which a large amount of energy produced by high-voltage electric pulse discharge directly acts on a coal reservoir to form a plasma channel in the coal bed between a positive electrode and a negative electrode; the large amount of energy instantly passes through the plasma channel, and the produced high-temperature thermal expansion force and shock waves act on the coal bed to form a large number of cracks in the coal bed and to cause pre-existing cracks to extend. Therefore, the method can effectively increase the number of cracks and extend the length of the cracks in the coal bed, creates a favorable condition for flowing of coalbed methane, and has good application prospects in increasing the yield of coalbed methane wells.

Technical solution: the permeability enhancement method for coalbed methane wells by using electric pulse detonation fracturing technology according to the present invention includes the following steps:

a. constructing a positive electrode coalbed methane wellbore and a negative electrode coalbed methane wellbore from the ground surface to a coal bed; placing, by using a derrick, a fixed platform installed with a positive electrode and a high-voltage pulse device arranged on the fixed platform downwards to a predetermined permeability enhancement portion of the coal bed in the positive electrode coalbed methane wellbore, and placing, by using a derrick, another fixed platform installed with a negative electrode downwards to a predetermined permeability enhancement portion of the coal bed in the negative electrode coalbed methane wellbore, the negative electrode being connected to the positive electrode through a cable;

b. adjusting, by using a console, the fixed platforms in the positive electrode coalbed methane wellbore and the negative electrode coalbed methane wellbore, such that upper portions of the fixed platforms are in close contact with wellbore walls, the positive electrode and the negative electrode on the two fixed platforms are then in close contact with the wellbore walls respectively, and the positive electrode and the negative electrode are arranged face to face on the same level;

c. turning on a high-voltage electric pulse switch to charge the high-voltage pulse device through a cable, where upon reaching a set discharge voltage, the high-voltage pulse device discharges electricity to the coal bed between the positive electrode and the negative electrode through the positive electrode; and turning off the high-voltage electric pulse switch after 10 to 100 times of discharge;

d. moving the fixed platform installed with the positive electrode and the high-voltage pulse device out of the positive electrode coalbed methane wellbore, moving the other fixed platform installed with the negative electrode out of the negative electrode coalbed methane wellbore, and starting coalbed methane extraction according to conventional techniques.

The high-voltage pulse device has a discharge frequency of 5 to 30 Hz and a voltage range of 500 to 9000 KV.

A distance between the positive electrode coalbed methane wellbore and the negative electrode coalbed methane wellbore is 150 to 1200 m.

The high-voltage pulse device includes a capacitor and a pulse trigger connected to the capacitor.

Beneficial effects: According to the present invention, a coal bed between a positive electrode and a negative electrode is broken down by using a large amount of energy produced by high-power electric pulse. The large amount of energy instantly passes through a plasma channel formed in the coal bed, and the produced high-temperature thermal expansion force and shock waves act on the coal body around the wall of the plasma channel to form a large number of cracks in the coal bed and to cause pre-existing cracks to extend. Therefore, the number of cracks in the coal bed and the extension length of the cracks can be effectively increased, and the permeability coefficient of the coal body can be improved by 150 to 350 times. The method has a simple construction process, is easy to operate and is safe and reliable. It can effectively increase the yield of coalbed methane per well, and is widely applied in the field.

Figure 1:
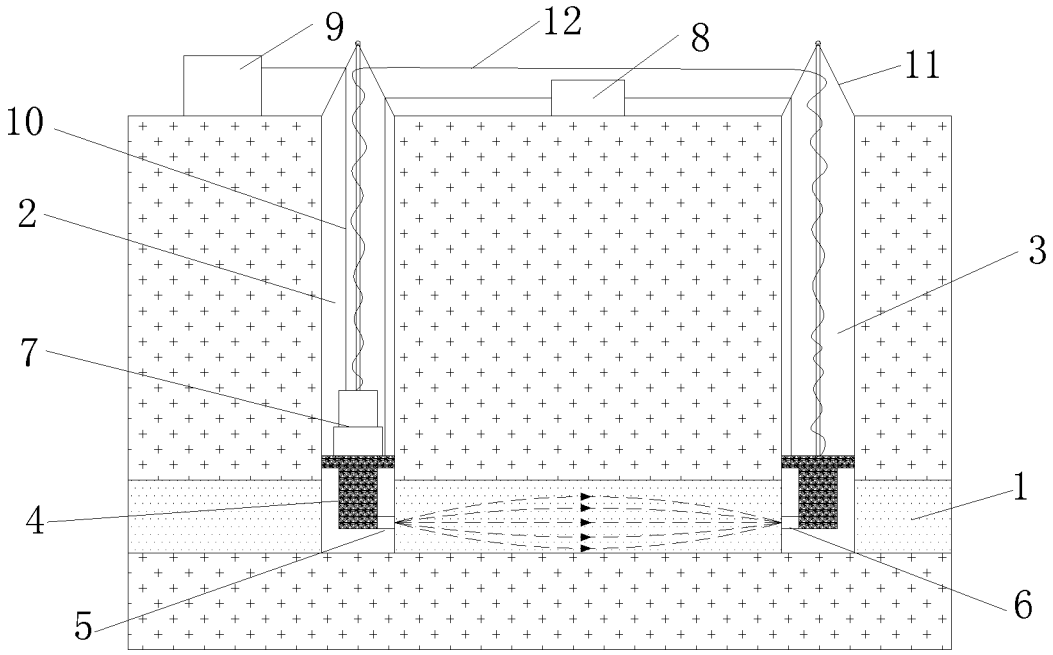
FIG. 1 is a schematic diagram of a permeability enhancement system for coalbed methane wells by using electric pulse detonation fracturing technology according to the present invention.

In the drawing: 1: coal bed, 2: positive electrode coalbed methane wellbore, 3: negative electrode coalbed methane wellbore, 4: fixed platform, 5: positive electrode, 6: negative electrode, 7: high-voltage pulse device, 8: console, 9: high-voltage electric pulse switch, 10: cable, 11: derrick, 12: cable, 13: capacitor, 14: pulse trigger.

DETAILED DESCRIPTION OF THE EMBODIMENTS

An embodiment of the present invention is further described below with reference to the accompanying drawings.

Figure 2:
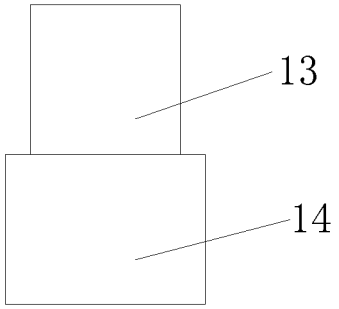
FIG. 2 is a structural diagram of a high-voltage electric pulse device.

As shown in FIG. 1 and FIG. 2, a permeability enhancement method for coalbed methane wells by using electric pulse detonation fracturing technology according to the present invention includes the following specific steps:

(1) constructing a positive electrode coalbed methane wellbore 2 and a negative electrode coalbed methane wellbore 3 from the ground surface to a coal bed 1, a distance between the positive electrode coalbed methane wellbore 2 and the negative electrode coalbed methane wellbore 3 being 150 to 1200 m; placing, by using a derrick 11, a fixed platform 4 installed with a positive electrode 5 and a high-voltage pulse device 7 arranged on the fixed platform 4 downwards to a predetermined permeability enhancement portion of the coal bed 1 in the positive electrode coalbed methane wellbore 2, the high-voltage pulse device 7 including a capacitor 13 and a pulse generator 14 connected to the capacitor 13; and placing, by using a derrick 11, another fixed platform 4 installed with a negative electrode 6 downwards to a predetermined permeability enhancement portion of the coal bed 1 in the negative electrode coalbed methane wellbore 3, the negative electrode 6 being connected to the capacitor 13 of the high-voltage pulse device 7 in the positive electrode coalbed methane wellbore 2 through a cable 12;

(2) adjusting, by using a console 8, the fixed platforms 4 in the positive electrode coalbed methane wellbore 2 and the negative electrode coalbed methane wellbore 3, such that upper portions of the fixed platforms 4 are in close contact with wellbore walls, the positive electrode 5 on the fixed platform 4 in the positive electrode coalbed methane wellbore 2 and the negative electrode 6 on the fixed platform 4 in the negative electrode coalbed methane wellbore 3 are then in close contact with the wellbore walls respectively, and the positive electrode 5 and the negative electrode 6 are arranged face to face on the same level;

(3) turning on a high-voltage electric pulse switch 9 to charge the high-voltage pulse device 7 through a cable 10, where upon reaching a set discharge voltage, the high-voltage pulse device 7 discharges electricity to the coal bed between the positive electrode 5 and the negative electrode 6 through the positive electrode 5; and turning off the high-voltage electric pulse switch 9 after 10 to 100 times of discharge, where the high-voltage pulse device 7 has a discharge frequency of 5 to 30 Hz and a voltage range of 500 to 9000 KV; for example, the high-voltage electric pulse switch 9 is turned off after discharge is carried out on the coal bed between the positive electrode 5 and the negative electrode 6 at a frequency of 5 Hz for 15 times; and (4) moving the fixed platform 4 installed with the positive electrode 5 and the high-voltage pulse device 7 out of the positive electrode coalbed methane wellbore 2, moving the other fixed platform 4 installed with the negative electrode 6 out of the negative electrode coalbed methane wellbore 3, and starting coalbed methane extraction in the positive electrode coalbed methane wellbore 2 and the negative electrode coalbed methane wellbore 3 according to conventional techniques.

What is claimed is:

1. A permeability enhancement method for coalbed methane wells by using electric pulse detonation fracturing technology, comprising the following steps:

a. constructing a positive electrode coalbed methane wellbore (2) and a negative electrode coalbed methane well bore (3) from the ground surface to a coal bed (1); placing, by using a derrick (11), a fixed platform (4) installed with a positive electrode (5) and a high-voltage pulse device (7) arranged on the fixed platform (4) downwards to a predetermined permeability enhancement portion of the coal bed (1) in the positive electrode coal bed methane well bore (2), and placing, by using a derrick (11), another fixed platform (4) installed with a negative electrode (6) downwards to a predetermined permeability enhancement portion of the coal bed (1) in the negative electrode coalbed methane wellbore (3), the negative electrode (6) being connected to the high-voltage pulse device (7) through a cable (12), wherein the high-voltage pulse device (7) has a discharge frequency of 5 to 30 Hz and a voltage range of 500 to 9000 KV;

b. adjusting, by using a console (8), the fixed platforms (4) in the positive electrode coalbed methane wellbore (2) and the negative electrode coalbed methane wellbore (3), such that upper portions of the fixed platforms (4) are in close contact with wellbore walls, the positive electrode (5) and the negative electrode (6) on the two fixed platforms (4) are then in close contact with the wellbore walls respectively, and the positive electrode (5) and the negative electrode (6) are arranged face to face on the same level;

c. turning on a pulse switch (9) to charge the high-voltage pulse device (7) through a cable (10), wherein upon reaching a set discharge voltage, the high-voltage pulse device (7) discharges electricity to the coal bed between the positive electrode (5) and the negative electrode (6) through the positive electrode (5); and turning off the pulse switch (9) after 10 to 100 times of discharge;

d. moving the fixed platform (4) installed with the positive electrode (5) and the high-voltage pulse device (7) out of the positive electrode coalbed methane wellbore (2), moving the other fixed platform (4) installed with the negative electrode (6) out of the negative electrode coal bed methane wellbore (3), and starting coal bed methane extraction.

2. The permeability enhancement method for coalbed methane wells by using electric pulse detonation fracturing technology according to claim 1, wherein a distance between the positive electrode coalbed methane wellbore (2) and the negative electrode coalbed methane wellbore (3) is 150 to 1200 m.

3. The permeability enhancement method for coalbed methane wells by using electric pulse detonation fracturing technology according to claim 1, wherein the high-voltage pulse device (7) comprises a capacitor (13) and a pulse trigger (14) connected to the capacitor (13).

* * * * *